US011919685B2

(12) United States Patent
Suokas et al.

(10) Patent No.: US 11,919,685 B2
(45) Date of Patent: Mar. 5, 2024

(54) PRODUCT PACKAGE AND PRODUCT PACKAGE BLANK

(71) Applicant: Jospak Oy, Forssa (FI)

(72) Inventors: Jouni Suokas, Tammela (FI); Taneli Mero, Forssa (FI); Ari Lehikoinen, Helsinki (FI)

(73) Assignee: JOSPAK OY, Forssa (FI)

( * ) Notice: Subject to any disclaimer, the term of this patent is extended or adjusted under 35 U.S.C. 154(b) by 1053 days.

(21) Appl. No.: 16/498,417

(22) PCT Filed: Mar. 9, 2018

(86) PCT No.: PCT/FI2018/050174
§ 371 (c)(1),
(2) Date: Sep. 27, 2019

(87) PCT Pub. No.: WO2018/178508
PCT Pub. Date: Oct. 4, 2018

(65) Prior Publication Data

US 2021/0086941 A1 Mar. 25, 2021

(30) Foreign Application Priority Data

Mar. 29, 2017 (FI) ..... 20175295
Nov. 13, 2017 (FI) ..... 20176011

(51) Int. Cl.
*B65D 5/20* (2006.01)
*B65D 5/56* (2006.01)
(Continued)

(52) U.S. Cl.
CPC ..... *B65D 5/209* (2013.01); *B65D 5/2033* (2013.01); *B65D 5/56* (2013.01); *B65D 21/0233* (2013.01);
(Continued)

(58) Field of Classification Search
CPC ..... B65D 5/209; B65D 5/2033; B65D 5/56; B65D 21/0233; B65D 77/2024;
(Continued)

(56) References Cited

U.S. PATENT DOCUMENTS 3,316,102 A 4/1967 Doll et al.
3,547,722 A 12/1970 Andersson
3,917,155 A * 11/1975 Bemiss ..... B65D 5/243 229/160
4,130,236 A * 12/1978 Manizza ..... B65D 5/246 229/114
(Continued)

FOREIGN PATENT DOCUMENTS

EP 2441696 4/2012
EP 2965997 1/2016
(Continued)

*Primary Examiner* — Christopher R Demeree
(74) *Attorney, Agent, or Firm* — Clark & Brody LP

(57) ABSTRACT

A product package includes a frame part provided with a base and walls. Edge parts on the top edge of the walls are folded outwards to form a flat edge section, where the frame part is a recess for product packing. The frame part is preferably a recyclable fiber material and the recess is lined on the inside with a separate inner lining removable from the frame part. The edge section functions as a fastening surface for the inner lining. The inner lining and the edge parts are arranged to form a one-piece and unbroken edge section of the package as a fastening surface for the inner lining. Adjacent edge parts are fastened in a leakproof manner at their ends to each other with a butt seam forming a corner seam and the fastening is reinforced with a reinforcement piece fastened under the corner seam and edge section ends.

16 Claims, 7 Drawing Sheets

Figure 1:
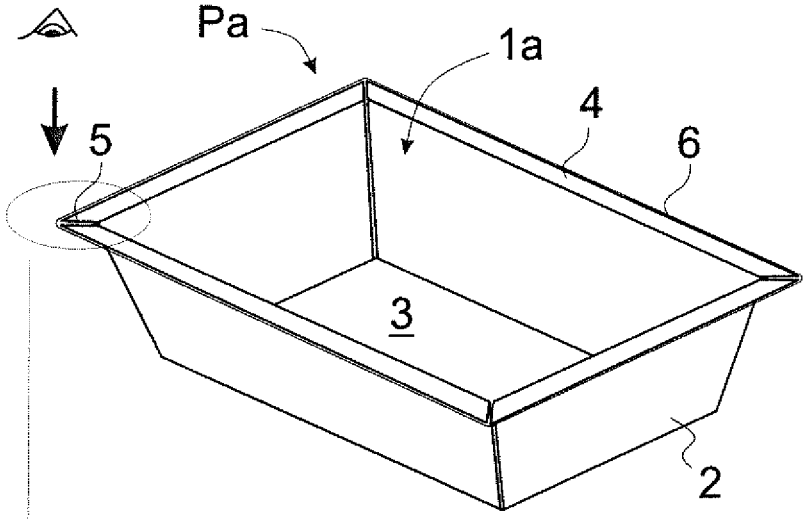
Fig. 1 Prior art

(51) Int. Cl.
*B65D 21/02* (2006.01)
*B65D 77/20* (2006.01)

(52) U.S. Cl.
CPC ..... *B65D 77/2024* (2013.01); *B65D 2301/00* (2013.01); *B65D 2565/385* (2013.01)

(58) Field of Classification Search
CPC ..... B65D 5/246; B65D 5/563; B65D 2577/2025; B65D 81/3453; B65D 5/243; B65D 7/08; B65D 5/28; B65D 5/20; B65D 1/34; B65D 25/14; B65D 2543/00194; B65D 5/0015; B65D 5/443; B65D 85/1036; B32B 2439/70
USPC ..... 229/109, 186, 169, 125.35, 170, 114, 229/902, 199, 407; 206/484, 557, 499, 206/519; 426/127, 34.2, 36.7; 220/62.13
See application file for complete search history.

(56) References Cited

U.S. PATENT DOCUMENTS

| | | | | |
|---|---|---|---|---|
| 4,247,038 | A * | 1/1981 | Forbes, Jr. | B65D 5/2033 229/903 |
| 4,718,596 | A * | 1/1988 | Muller | B65D 5/2033 229/109 |
| 5,326,021 | A | 7/1994 | Farrell et al. | |
| 9,144,939 | B2 * | 9/2015 | Balke | B29C 65/5071 |
| 10,647,466 | B2 * | 5/2020 | Zwaga | B65D 5/563 |
| 11,358,779 | B2 * | 6/2022 | Tye | B65D 77/22 |
| 2006/0006215 | A1 | 1/2006 | Chen | |

FOREIGN PATENT DOCUMENTS

| | | |
|---|---|---|
| GB | 1314148 | 4/1973 |
| GB | 1447543 | 8/1976 |
| JP | 11-240536 | 9/1999 |
| JP | 2001-206345 | 7/2001 |

* cited by examiner

PRODUCT PACKAGE AND PRODUCT PACKAGE BLANK

The object of the invention is a product package, such as e.g. a foodstuff package, as presented in the preamble of claim 1, the package being produced mainly from recyclable fiber material, and a method as presented in the preamble of claim 14 for producing the aforementioned product package, and also a product package blank as presented in the preamble of claim 20 for producing, inter alia, a product package according to claim 1. An advantageous material option can be corrugated fiberboard, paperboard or some other suitable recyclable fiber material.

Known in the art are various foodstuff packages, in which are packed e.g. convenience foods, which can be heated in a microwave oven or corresponding. Most of these types of packages are nowadays fabricated wholly from plastic, which cannot be recycled. This produces a large environmental problem. The frame of a package is manufactured from some suitable plastic and it is lined inside with a separate food-grade film. The package is shaped into a suitable shape in such a way that the desired amount of food can be packed into it. The shaping also comprises a horizontal edge flange circling the whole of the top edge of the package, which flange is intended as a fastening surface and a sealing base for the package lid, with which the package is closed in a leakproof manner by heat sealing when the package has been filled and, if necessary, the food in it cooked. Often the food in a package must be cooked to completion before it can be sent onwards for sale as convenience food. A problem arises if the cooking takes place at a high temperature, such as in an oven, which not all the plastics of package boxes endure, but instead special plastics that are expensive must be used in the boxes.

Also known in the art are foodstuff packages that are produced e.g. from paperboard or corresponding and lined inside with a separate food-grade film, as in conventional plastic packages. One such solution is disclosed in patent specification no. EP2441696. On the top edge of the foodstuff package produced from cardboard and described in the specification in question is an essentially horizontal flat edge flange pointing sideways, for the fastening of the lid, as also in the plastic package described earlier. The package is additionally lined on the inside with a food-grade film in such a way that the film also comes onto the top of the edge flange. A problem in this solution is, inter alia, that the cardboard package is supported in its shape by means of just the food-grade film lined from the inside, as a result of which the package is not torsionally rigid and the seam points of the edge flange on the top edge are not leakproof and even. The aforementioned increases the risk that irregularities and gaps remain between the food-grade film drawn onto the top of the edge flange and the lid heat-sealed to it, in which case, among other things, the gastightness of the foodstuff package is lost and external air can enter the foodstuff package. If the sealing does not reliably succeed and the package is not sufficiently leakproof, the package has to be wrapped inside separate plastic, which in turn increases the material costs and space requirement, and the package is not as neat in its outward appearance as without this additional wrapping.

To save space, the finished product package boxes are advantageously stored and kept nested together one on top of another in product package stacks. During storage and transportation, however, a product package stack often compacts and taking an individual product package box from the stack of product package boxes can be awkward. The process filling for filling a product package box is automatic and picking an individual product package box from a product package stack is performed mechanically. Product package boxes that have compacted and become attached to each other cause disruptions in the filling process, which in turn lengthens the manufacturing time of a product batch reduces efficiency in the production process.

Sometimes a paperboard or corrugated fiberboard package is folded to be suitable from a flat package blank. To minimize costs, it is endeavored to produce a package blank completely from one blank, but often e.g. the corners of a foodstuff package are folded in such a way that there is more than one layer of material overlapping at the point of the crease in the walls or especially in the corners. The aforementioned drawback in the manufacture of a foodstuff package causes extra costs, in the form of wasted material.

The aim of the present invention is to eliminate the aforementioned drawbacks and to provide an inexpensive, stout and stackable product package that is both space efficient and cost efficient. Another aim is to provide a product package, the fastening of the lid of which is reliable and the product package is therefore leakproof when it is closed with a lid. Likewise, one aim is to provide a one-piece product package blank, from which a product package enabling airtightness and watertightness can easily be folded. Additionally, the purpose of the present invention is to provide a stackable product package that when stacked in a nested manner does not cause compaction of the stack, and which product package stacks can be reliably utilized in a mechanical process for filling product packages. The product package according to the invention is characterized by what is disclosed in the characterization part of claim 1. Correspondingly, the method according to the invention for producing the aforementioned product package is characterized by what is disclosed in the characterization part of claim 14, and the product package blank according to the invention for producing the aforementioned product package is characterized by what is disclosed in the characterization part of claim 20. Other embodiments of the invention are characterized by what is disclosed in the other claims.

The product package according to the invention comprises a frame part provided with a base and with walls in connection with the base, and also with edge parts on the top edge of the walls, said edge parts being folded outwards and forming an essentially flat edge section, in which frame part is a recess for the product to be packed, and which frame part is preferably formed, by means of folds, from recyclable fiber material and which recess is lined on the inside with a separate inner lining that is removable from the aforementioned frame part, and in which product package the aforementioned edge section is arranged to function as a fastening surface for the aforementioned inner lining. Before fastening the inner lining, the edge parts of the frame part are arranged to form an even, one-piece and essentially unbroken edge section of the product package as a fastening surface for the inner lining, and the adjacent edge parts of the frame part are fastened in a leakproof manner at their ends to each other with a butt seam forming a corner seam, the fastening of which is reinforced with a reinforcement piece fastened under the ends of the corner seam and the edge parts. In the frame part are two or more walls extending upwards from the base, between the ends of which walls is a dividing wall extending upwards, on the top end of which dividing wall is a reinforcement piece for fastening the ends of the edge parts and for reinforcing the corner seam. The frame part comprises more than one support part to keep the nested product packages at a distance from each other.

In the method according to the invention a recess, provided with a base and walls, for the product to be packed is formed for the product package, and the frame part of the recess as well as the flat edge section comprised of edge parts are preferably formed, by means of folds, from recyclable fiber material, and the aforementioned recess as well as the flat edge section is lined with a separate inner lining, which is removable from the aforementioned frame part. The method according to the invention for producing a product package is characterized in that before fastening the inner lining, an even, one-piece and essentially unbroken edge section of the product package is formed from the edge parts of the frame part as a fastening surface for the inner lining. Before fastening the inner lining, the adjacent edge parts of the frame part are fastened in a leakproof manner at their ends to each other with a butt seam forming a corner seam, and the fastening is reinforced by fastening a reinforcement piece under the butt seam and the ends of the edge parts.

The product package according to the invention comprises a sheet-like structure manufactured from recyclable fiber material, the structure comprising a base sector, wall sectors and edge sectors separated with folding lines and scores, for the base, walls and edge parts of a product package to be manufactured by folding from the product package blank. Preferably, on the product package blank between the wall sectors are dividing wall sectors, separated from the base sector with folding lines, for the dividing walls, on the free end of which dividing wall sectors is a reinforcement piece separated by means of a folding line for reinforcing the mutual fastening point of the ends of adjacent edge parts. The product package blank comprises support parts formed from wall sectors.

More than one support part is formed near the folding lines of the frame part. In a preferred solution the support parts of the frame part of the product package are formed from score patterns of the support parts in the product package blanks. In another preferred solution the support parts of the frame part of the product package are formed before placement of the inner lining by folding the support parts cut in the side walls and end walls of the frame part outwards from the surface plane of the walls.

One advantage, among others, of the solution according to the invention is that the product package is made mainly from recyclable material, which almost entirely eliminates the environmental problems associated with plastic packages. Another advantage is that the flat edge section, coated with an inner lining, of the product package is essentially one-piece and even throughout, in which case closing the product package with the lid can be done securely and reliably, and the package becomes fully leakproof. From this follows the advantage that possible additional wrapping plastics are not needed and a foodstuff can be packed e.g. in a protective gas, which increases the shelf life of the foodstuff.

One advantage is also that the product package according to the invention is folded from one paperboard blank or corrugated fiberboard blank in such a way that the material sectors that are one above another are minimized to only four small fastening surfaces in the corners, thus saving both manufacturing material and costs. Another advantage also is that the solution attached with glue, or fastened in some other manner, makes a product package extremely robust and torsionally rigid.

Another advantage, among others, is also that a product package is made to be easily stackable in a nested manner in such a way that a finished product package stack does not compact during storage and transportation. Another advantage is that an individual product package is easily taken from the product package stack. The preceding enables a reliable mechanical process for filling product packages, in which case there are fewer problem situations in the filling process and the throughput time of the process is speeded up.

Figure 1A:
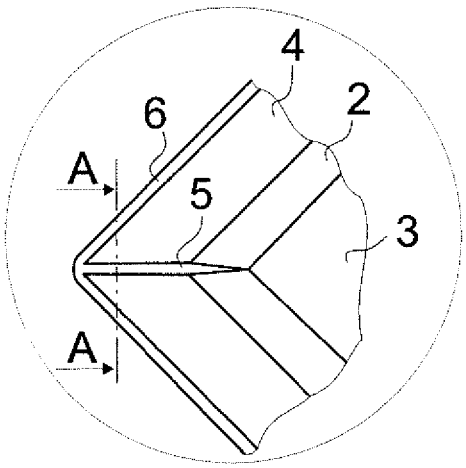
Figure 1B:
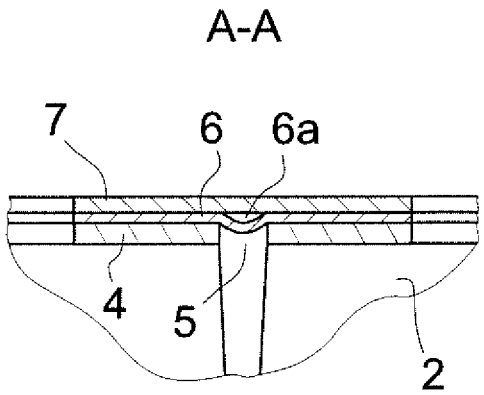
Figure 2:
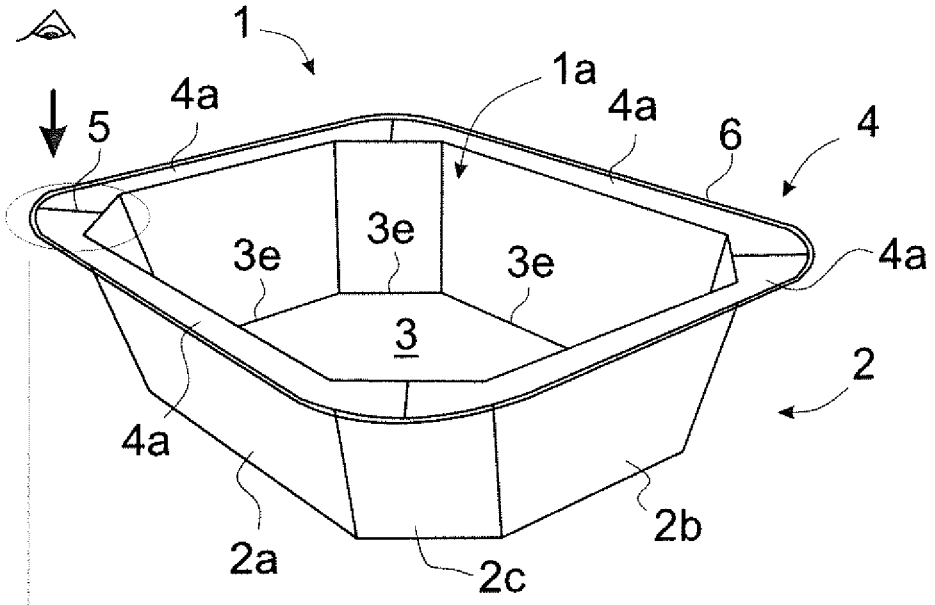
Figure 2A:
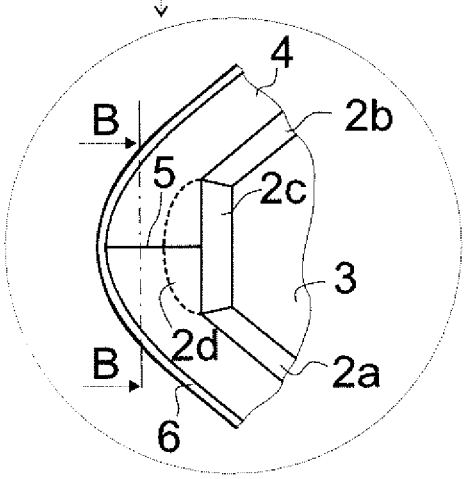
Figure 2B:
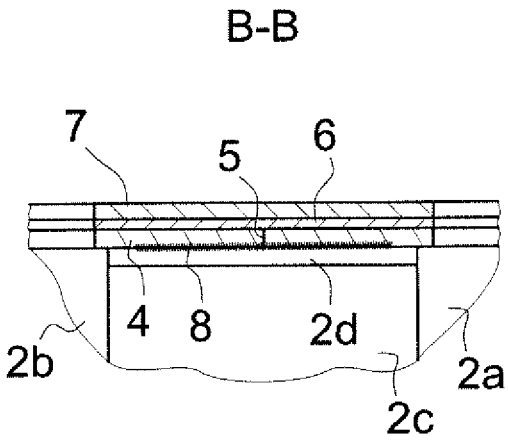
Figure 3:
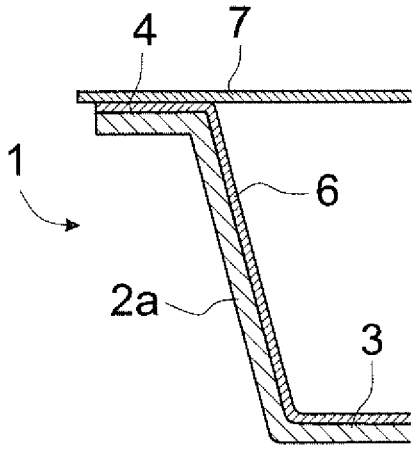
Figure 4:
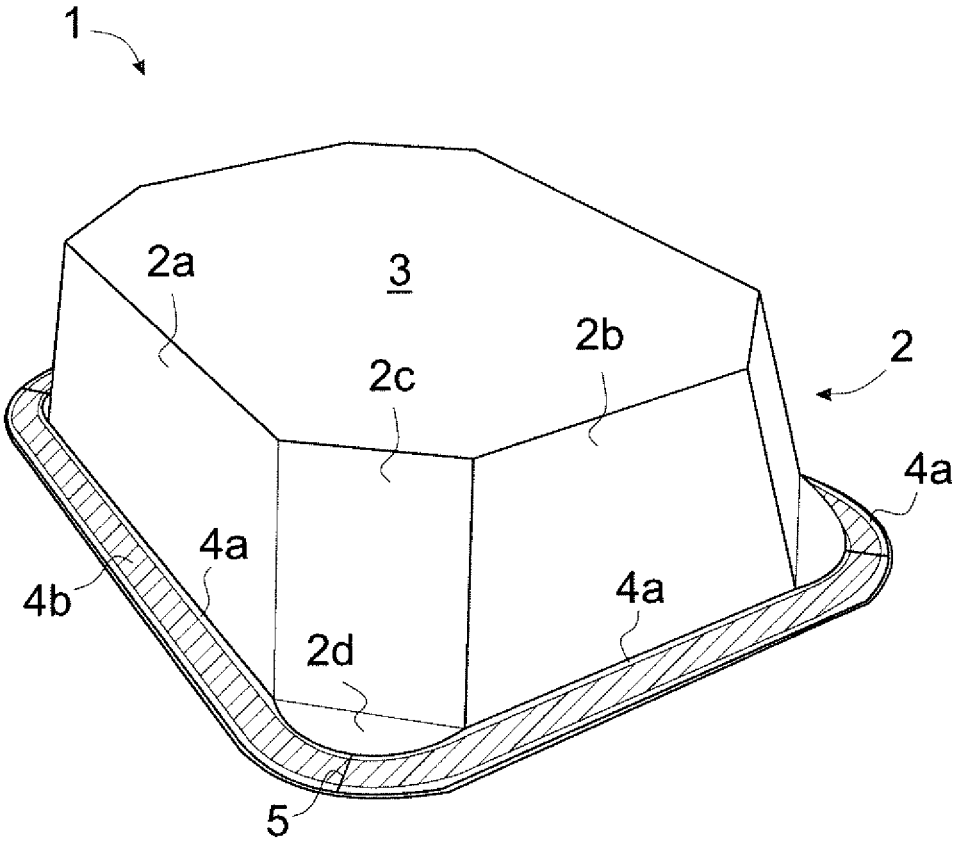
Figure 5:
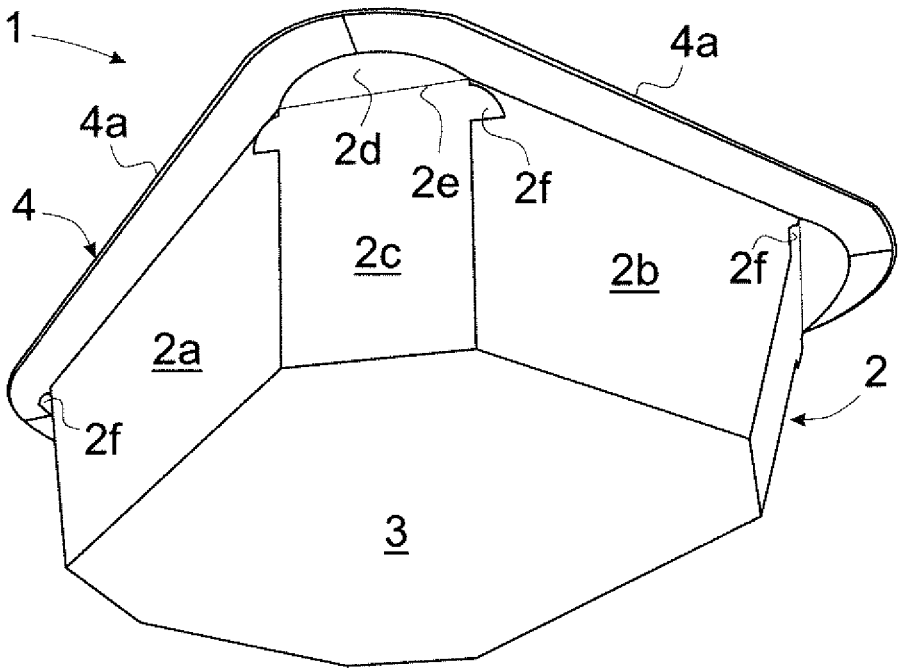
Figure 6:
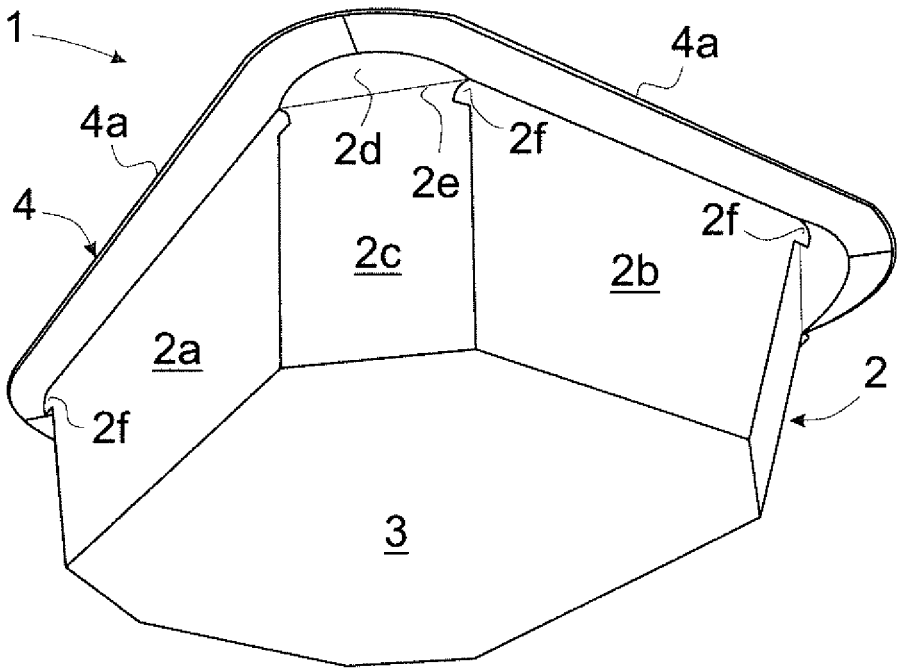
Figure 7:
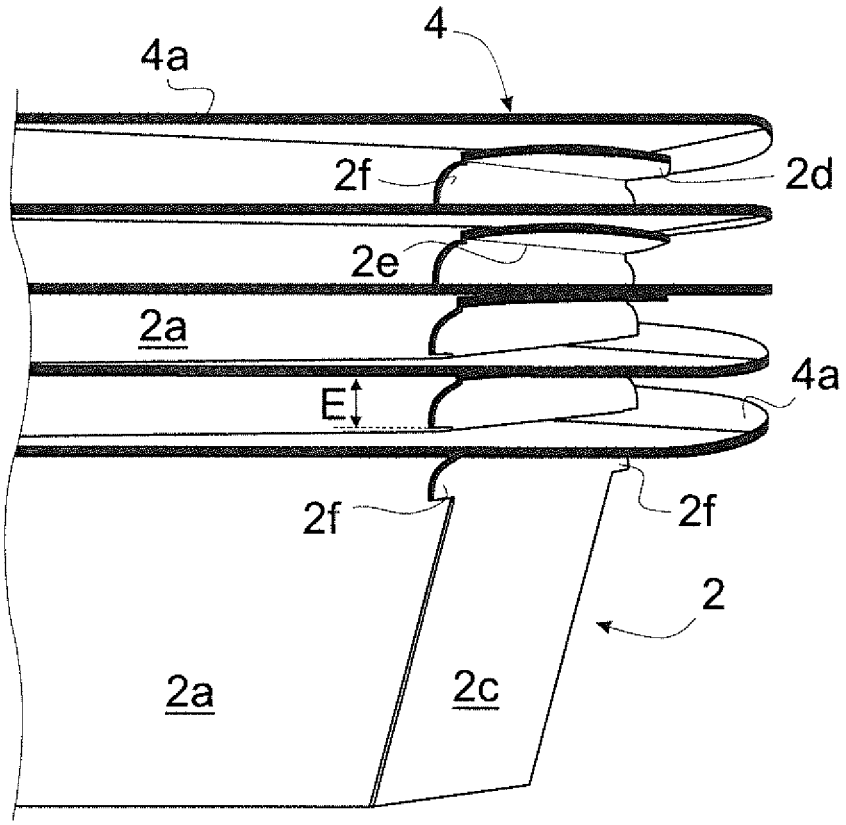
Figure 8:
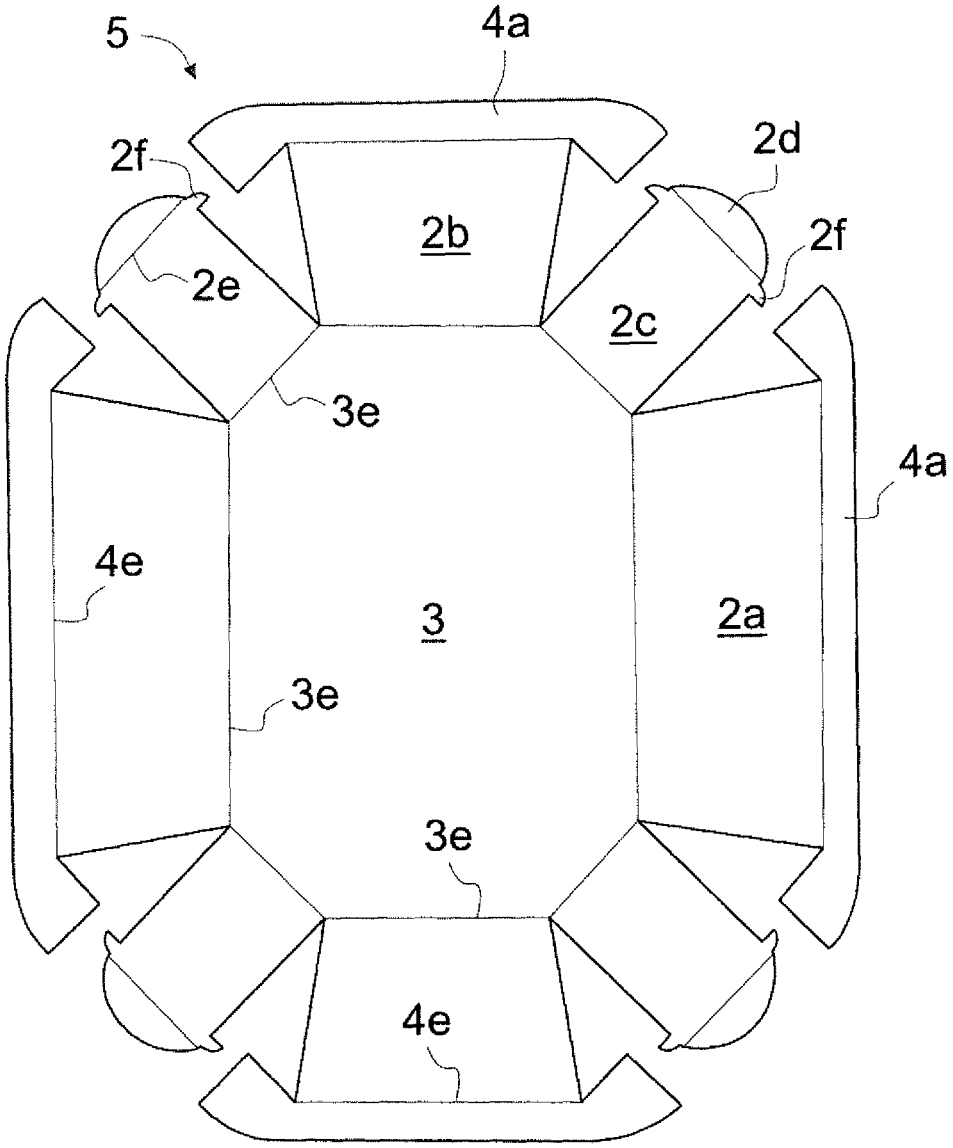

In the following, the invention will be described in more detail by the aid of one of its embodiments with reference to the attached drawings, wherein FIG. 1 presents one product package according to what is known in the art as viewed obliquely from the side and from above, FIG. 1*a* presents a simplified top view, not to scale, of a non-integral corner of a prior art product package according to FIG. 1, FIG. 1*b* presents a simplified side view, partially sectioned and not to scale, of a non-integral corner of a prior art product package according to FIG. 1, and of the non-leakproof jointing solution for the lid, FIG. 2 presents one product package according to the invention as viewed obliquely from the side and from above, FIG. 2*a* presents a simplified top view, not to scale, of an integral corner of a product package according to FIG. 2, FIG. 2*b* presents a simplified side view, partially sectioned and not to scale, of an integral corner of a product package according to FIG. 2, and of the leakproof jointing solution for the lid, FIG. 3 presents a simplified side view, sectioned and not to scale, of a part of one product package according to the invention, the package being provided with a lid, FIG. 4 presents an oblique view from the side and from above of a product package box according to FIG. 2, the box being turned upside-down, FIG. 5 presents one stackable product package according to the invention as viewed obliquely from the side and from below, the product package having support parts on the dividing walls, FIG. 6 presents another stackable product package according to the invention as viewed obliquely from the side and from below, the product package having support parts on the side walls and on the end walls, FIG. 7 presents a simplified side view, not to scale, of product packages according to FIG. 1 stacked one on top of another in a nested manner, and FIG. 8 presents a top view of one product package according to the invention as an opened blank before it has been folded into a product package.

FIGS. 1, 1*a* and 1*b* present one product package Pa according to prior art (Prior Art: EP 2441696 A1). For illustration purposes, the thickness of the package material and of the films is exaggerated in some of the figures.

In FIG. 1 this product package Pa according to prior art is presented as viewed obliquely from the side and from above. The product package Pa is folded and assembled from one paperboard blank. The product package Pa comprises a frame part 2 and an inner lining 6. Correspondingly, the frame part 2 comprises a base 3, two side walls and two end walls as well as an essentially flat edge section 4 extending outwards to the side from the top edge of the side walls and end walls. Some suitable recyclable fiber material, such as paperboard, is used as the manufacturing material of the frame part 2. The product package Pa stays in its intended shape just from the support of a thin food-grade plastic used as an inner lining 6, the plastic being laminated into attachment with the frame part 2, which makes the structure weak and unsteady.

FIG. 1*a* presents a simplified top view, not to scale, of a non-integral corner of the product package Pa according to FIG. 1. The aforementioned structure made to be supported by just the inner lining causes, in the assembly phase of the product package Pa during which the inner lining 6 is fastened to the frame part 2 and to the flat edge section 4, small gaps to remain in the corner seams 5 of the flat edge sections 4 of the product package Pa, which make the flat edge section 4 non-integral.

FIG. 1*b* presents a simplified side view, partially sectioned and not to scale, of a non-integral corner of the product package Pa according to FIG. 1, and of the non-leakproof jointing solution for the lid. When there is a gap in the corner seam 5 of the flat edge section 4 of the product package Pa, the food-grade plastic used in the inner lining 6 fastened onto the flat edge section 4 tries to shape itself in the direction of the gap, leaving a groove 6*a* in the direction of the corner seam 5 in the surface of the flat edge section. Later the product package Pa is filled with a food product and a lid film 7 is fastened onto the section of the inner lining 6 that is fastened onto the flat edge section 4 of the product package Pa, e.g. by heat sealing. The aforementioned grooves 6*a* shaped into the points of the corner seams 5 in the inner lining film 6 leave an air channel between the inner lining film 6 and the lid film 7 and therefore also into the recess 1*a* of the product package 1, in which case the product package is no longer airtight and is not necessarily even watertight. In product packages according to the structure in question, e.g. protective gases for improving the preservability of a food product cannot be used.

FIGS. 2, 2*a*, 2*b*, 3 and 4 present one product package 1 according to the invention. For illustration purposes, the thickness of the package material and of the films is exaggerated in some of the figures.

FIG. 2 presents one product package according to the invention as viewed obliquely from the side and from above. Preferably the product package 1 according to the invention is a foodstuff package, e.g. for a ready meal. The product package 1 comprises a frame part 2 and an inner lining 6. Correspondingly, the frame part 2 comprises a base 3, two side walls 2*a* and two end walls 2*b* and dividing walls 2*c* between them, in the corners of the product package, and in addition edge parts 4*a* extending outwards to the side from the top edge of the side walls and end walls, which edge parts form an essentially flat edge section 4 of the product package 1. A product package 1 produced in this way comprises a recess 1*a* for the product, such as a food portion, to be packed, the recess being provided with a base 3 and walls 2*a*-2*c*.

Some suitable recyclable fiber material is used as the manufacturing material of the frame part 2. Preferably the material is e.g. corrugated fiberboard, paperboard or some other suitable recyclable fiber material. The inner lining 6 is food-grade plastic and after use it can easily be detached from the frame part 2, in which case the frame part 2 can be delivered to recycling. The frame part 2 is produced by folding it e.g. mechanically, from the package blank 9 presented later in FIG. 5.

Four components of the flat edge section 4 connect to the side walls 2*a* and end walls 2*b* of the frame part 2 of the product package 1, i.e. edge parts 4*a* that are mechanically folded outwards from the side walls 2*a* and end walls 2*b* along folding lines 4*e*, i.e. creases, prefabricated in the package blank, to become a flat fastening surface, i.e. an edge section 4, for the inner lining 6 and lid film 7. The edge parts 4*a* of the edge section 4 are connected to each other with a butt seam in the corners of the product package, in which case leakproof corner seams 5 form in the corners of the edge section 4.

FIG. 2*a* presents a simplified top view, not to scale, of one integral corner of the product package 1 according to FIG. 2. The edge parts 4*a* on the top edge of an end wall 2*b* and a side wall 2*a* of the frame part 2 are mechanically folded before the fastening of the inner lining 6 to become a single-piece and even and unbroken edge section 4 of the product package 1 in such a way that the aforementioned two edge parts 4*a* are connected to each other at their ends with a leakproof butt seam, forming a corner seam 5. On the free end, i.e. the top part, of the dividing wall 2*c* of the frame part is a reinforcement piece 2*d*, which is folded mechanically under the end of the two aforementioned edge parts 4*a* at the point of the corner seam 5 and fastened from below into attachment with the aforementioned edge parts 4*a* by means of glue or some other suitable fastening means or fastening substance. The reinforcement piece 2*d* is intended for reinforcing the corner seam 5 of the ends of the edge parts 4*a*.

In a product package according to the embodiment, the ends of the edge parts 4*a* form the corners of the edge section 4. The corners formed in this way can be straight on their outer edges, as viewed from above, but the corners can just as well be curved, in which case they form round corners of the product package 1, as in the product package 1 according to the embodiment.

FIG. 2*b* presents a simplified side view, partially sectioned and not to scale, of an integral corner of the product package according to FIG. 2 and of a leakproof jointing solution for the lid. The aforementioned corner seam 5 formed by two adjacent edge parts 4*a* is leakproof, and no kinds of gap remain between the edge parts 4*a*. The reinforcement piece 2*d* on the top end of a dividing wall 2*c* is folded in a leakproof manner under the ends of the edge parts 4*a* at the point of the corner seam 5 and fastened by gluing 8 into attachment with the bottom surface of the ends of the edge parts 4*a*, preferably in conjunction with the folding into shape of the blank 9 of the product package.

The manufacturing method enables a one-piece and essentially even and unbroken, flat edge section 4 of the product package 1, in which case no gaps remain in the corner seams 5. The fastening of the edge parts 4*a* forming the flat edge section 4 by gluing to the reinforcement piece 2*d* of the dividing walls 2*c* of the frame part 2 ensures that the corner seams 5 are not able to form gaps during further processing of the product package 1. Furthermore, a glued frame structure strengthens the product package 1 and makes it a torsionally rigid structure.

If necessary, the corner seam 5 between the ends of the edge parts 4*a* is filled with a filler material for ensuring the evenness of the top surface of the edge section 4 formed by the edge parts 4*a*. The filler material can preferably be e.g. the glue, with which the reinforcement piece 2*d* is fastened to the bottom surface of the ends of the edge parts 4*a*.

A plastic inner lining 6 is mechanically fastened onto the recess 1*a* of a folded and assembled product package 1 and onto the flat edge section 4. The plastic inner lining 6 is fastened to the frame part 2 and it is arranged to make the package airtight together with the lid 7. The fastening of the inner lining 6 is performed e.g. in such a way that negative pressure is produced below the frame part 2 and positive pressure above it. By means of the negative pressure the inner lining 6, which has glue on its bottom surface, is arranged to be sucked into attachment with the inside surface of the frame part 2. This occurs by sucking the air out from between the frame part 2 and the inner lining 6 placed inside it through the frame part 2 by means of the negative pressure. The positive pressure above the package also gives further assistance to the fastening. With the method described above the inner lining 6 is attached in a leakproof manner to the inside surface of the frame part 2 and on top of the edge section 4.

At the point of the corner seam 5 the inner lining 6 settles evenly onto the edge section 4, and the inner lining 6 is not able to form a groove or bump detrimental to the leakproofness of the product package 1. Later the product package 1 is filled with a food product and a lid film 7 is fastened onto the section of the inner lining 6 that is fastened onto the one-piece flat edge section 4 of the product package 1. The lid film 7 of the product package 1 is arranged to be fastened to the inner lining 6, e.g. with heat sealing or with some other suitable fastening method. At the aforementioned points of the corner seams 5 of the flat edge section 4, the lid film 7 settles in a leakproof manner against the inner lining film 6, ensuring the watertightness and airtightness of the recess 1*a* of the product package 1. Owing to its leakproofness, e.g. a protective gas for improving the preservability of a food product can be used in the product package 1 according to the invention.

FIG. 3 presents a simplified side view, sectioned and not to scale, of a part of one product package 1 according to the invention, the package being provided with a lid film 7. FIG. 3 illustrates how the recess 1*a* of the product package 1 and the flat edge section 4 are covered with a plastic inner lining film 6 and how the product package 1 containing a ready food product is closed at the point of the even and flat edge section 4 with a lid film 7 fastened to the inner lining film 6.

FIG. 4 presents the product package 1 according to FIG. 2, turned upside down and viewed obliquely from the side and from above. FIG. 4 illustrates how the dividing walls 2*c* of the frame part 2 of the product package 1 are fastened at their reinforcement pieces 2*d*, e.g. by means of glue, to at least two adjacent edge parts 4*a* of the frame part 2, i.e. in the solution according to the example to the ends of the edge parts 4*a* of the side wall 2*a* and of the end wall 2*b*, joining the edge parts 4*a* into a single-piece and even edge section 4 covering the whole product package 1. In this case leakproof corner seams 5 remain in the corner of the product package 1.

On the bottom surface of the edge parts 4*a* of the product package 1 is an essentially one-piece and even support surface 4*b*, which passes as a single piece around the product package 1. The seaming device utilizes this lower support surface 4*b* of the edge section 4 when the lid 7 of the product package 1 is heat sealed into attachment with the inner lining 3 fastened to the top of the edge section 4. Together with the upper edge section 4, the support surface 4*b* forms a seaming area of even thickness for the lid 7. The reinforcement pieces 2*d* fastened to the bottom surfaces of the edge parts 4*a* are of a suitable size, in which case they do not extend to the support surface 4*b*. That being the case, the material thickness is essentially the same in all the support surface 4*b* and in the seaming area of the lid 7.

FIG. 5 presents an oblique view from the side and from below of one stackable product package 1 according to the invention, in which are support parts 2*f* on the dividing walls 2*c*. Near the folding line 4*e* on the side edges of the dividing walls 2*c* are support parts 2*f*. Corresponding support parts are on each dividing wall 2*c* of the frame part, in which case there are in total eight support parts 2*f* in a product package 1. The dividing walls 2*c* are formed by folding them upwards from the crease lines 2*e* and by fastening the reinforcement piece 2*d* to the bottom of the corner of the edge section 4, in which case the support parts 2*f* cut in the package blank 5 protrude from the frame part 2 of the product package 1 below the edge parts 4.

FIG. 6 presents an oblique view from the side and from below of another stackable product package 1 according to the invention, in which are support parts 2*f* on the side walls 2*a* and on the end walls 2*b*. The product package 1 is otherwise similar to the product package 1 according to FIG. 5 but the support parts 2*f* are situated on the side walls 2*a* and on the end walls 2*b*. The product package 1 according to FIG. 6 is formed in a corresponding manner to the product package according to FIG. 5.

FIG. 7 presents a simplified side view, not to scale, of product packages 1 according to FIG. 5 stacked one on top of another and nested in each other. The support parts 2*f* protrude from the frame part 2 of the product packages 1. The support parts 2*f* of the upper product package 1 stacked inside the lower product package 1 rest on the top surface of the edge parts 4*a* of the flat edge section 4 of the lower product package 1, clearly separating the edge sections 4*a* of the lower product package 1 from the edge parts 4*a* of the upper product package. The distance of the edge parts 4*a* of the lower and upper product package from each other is of a regular interval along the whole distance of the flat edge section 4 of the product packages. The distance E of the support surface of the support part 2*f* to the bottom surface of the edge part 4*a* of the same product package 1 is suitably equal to or greater than one millimeter and preferably 4-6 millimeters.

FIG. 8 presents a top view of one preferred product package 1 according to the invention as an opened product package blank before it has been folded into a product package 1. Cuttings and folding lines 2*e*, 3*e* and 4*e* suited to the purpose are made in the product package blank 9 to facilitate mechanical folding of the product package at the fold points into a product package 1. The folding lines 2*e*, 3*e* and 4*e* can be made e.g. by creasing.

The product package blank 9 preferably comprises a sheet-like structure manufactured from recyclable fiber material, the structure comprising a base sector, wall sectors and edge sectors separated with folding lines 3*e*, 4*e* and cuttings, for the base 3, walls 2*a*, 2*b*, 2*c* and edge parts 4*a* of a product package 1 to be produced by folding from the product package blank. In one preferred solution, the base sector is separated along the folding lines 3*e* from the wall sectors forming the side walls 2*a* and end walls 2*b* and from the wall sectors forming the dividing walls 2*c*. In addition, the edge sectors forming the edge parts 4*a* of the product package 1 are separated along the folding lines 4*e* from the wall sectors forming the side walls 2*a* and end walls 2*b*. The dividing walls 2*c* are situated between the ends of the side walls 2*a* and end walls 2*b* to form a part of the wall structure of the finished product package. Preferably at the free end of the wall sectors forming the dividing walls 2*c* is a reinforcement piece 2*d* separated by means of a folding line 2*e*. Separated in this context does not mean separated into detachment, but instead refers to the making of a folding line 2*e*, 3*e*, 4*e*. Support parts 2*f* are shaped near the folding lines 4*e* on the sides of the dividing walls 2*c*.

Preferably, the distance of the folding line 2*e* of the reinforcement piece 2*d* from the folding line 3*e* surrounding the base sector is smaller by the extent of the material thickness of the product package blank 9 than the distance of the folding line 4*e* of the edge sectors from the folding line 3*e* surrounding the base sector.

In the embodiments presented above the purpose of the support parts 2*f* is to keep the nested product packages 1 at a distance from each other. The distance E of the support surface of the support part 2*f* to the bottom surface of the edge part 4*a* of the same product package 1 is suitably equal to or greater than 1 millimeter and preferably 4-6 millimeters.

Stacked product packages 1 separated from each other with suitably at least three support parts 2*f* are not able to compact against each other, but instead a clear distance remains between the edge parts 4*a* of two product packages 1 one on top of the other, which enables implementation of an easy and disruption-free process for filling the product packages.

It is obvious to the person skilled in the art that the invention is not limited solely to the examples described above, but that it may be varied within the scope of the claims presented below. Thus, for example, some structural solutions can also be different to what is presented above. In such a case, e.g. the fastening of the dividing walls to the flat edge parts can be done, instead of by gluing, e.g. by taping with, inter alia, double-sided tape.

It is also obvious to the person skilled in the art that the product packages can also be different in shape to what is presented above. The simplest and most common frame part of a product package is e.g. of a rectangular shape. However, the shape of a package can be other than the box-type rectangular shape 2. Thus, the shape can be e.g. polygonal or also round or oval, depending on e.g. the folding lines prefabricated in the blank. When the shape differs from a quadrangle, the number of walls can also differ from what is presented above, in which case e.g. there are not necessarily separate side walls and end walls, but instead e.g. two curving walls, between the ends of which are dividing walls, with reinforcement pieces, according to the invention. Also, e.g. the angle between the base and walls can be rounded out with one additional fold in the walls in the proximity of the base. Furthermore, the shape can also be asymmetrical.

It is further obvious to the person skilled in the art that the product packages can be of some other material than recyclable fiber material. Thus, the frame part of a product package can be produced from some other foldable material than corrugated fiberboard. The frame part of a product package can be produced e.g. from different fiberboards, paperboards or papers or also from woven material, or from combinations of different materials.

It is further obvious to the person skilled in the art that e.g. the shape, location or number of support parts can vary. Also, the distance between stacked product packages can vary from what is presented above. Thus, for example, support parts made on the opposite ends and sides of the product package or two elongated support parts are sufficient to keep nested and stacked product packages at a distance from each other.

The invention claimed is:

1. A product package, which comprises a frame part (2) provided with a base (3) and with walls (2*a*, 2*b*) in connection with the base (3) as well as with edge parts (4*a*) on the top edge of the walls, said edge parts being folded outwards and forming an essentially flat edge section (4), in which frame part (2) is a recess (1*a*) for the product to be packed, and which frame part (2) is preferably formed, by means of folds, from recyclable fiber material and which recess (1*a*) is lined on the inside with a separate inner lining (6) that is removable from the aforementioned frame part (2), and in which product package the aforementioned edge section (4) is arranged to function as a fastening surface for the aforementioned inner lining (6), characterized in that before fastening the inner lining (6), the edge parts (4*a*) of the frame part (2) are arranged to form an even, single-piece and essentially unbroken edge section (4) of the product package as a fastening surface for the inner lining (6), and in that the adjacent edge parts (4*a*) of the frame part (2) are fastened in a leakproof manner at their ends to each other with a butt seam forming a corner seam (5), and the fastening is reinforced with a reinforcement piece (2*d*) fastened under the corner seam (5) and the ends of the edge parts (4*a*).

2. The product package according to claim 1, characterized in that in the frame part (2) are two or more walls (2*a*, 2*b*) extending upwards from the base (3), between the ends of which walls is a dividing wall (2*c*) extending upwards, on the top end of which dividing wall is a reinforcement piece (2*d*) for reinforcing the corner seam (5) between the ends of the edge parts (4*a*).

3. The product package according to claim 2, characterized in that a dividing wall (2*c*) is arranged to form a part of the wall structure of the frame part (2), and in that the dividing wall (2*c*) is shallower than the other walls (2*a*, 2*b*) by the extent of the material thickness of the material of the frame part (2).

4. The product package according to claim 1, characterized in that, if necessary, the corner seam (5) between the ends of the edge parts (4*a*) is filled with a filler material for ensuring the evenness of the top surface of the edge section (4) formed by the edge parts (4*a*).

5. The product package according to claim 1, characterized in that on the bottom surface of the edge parts (4*a*) is an essentially single-piece and even support surface (4*b*), which together with the upper edge section (4) is arranged to form a seaming area of essentially even thickness.

6. The product package according to claim 1, characterized in that the frame part (2) comprises two side walls (2*a*) and two end walls (2*b*) as well as dividing walls (2*c*) situated between the ends of the side walls and end walls, which dividing walls (2*c*) are a part of the wall structure of the frame part (2).

7. The product package according to claim 1, characterized in that the inner lining (6) is arranged to form into the shape of the recess (1*a*) and arranged to settle onto the flat edge section (4) of the product package to become an even and one-piece fastening surface for the lid (7) of the product package.

8. The product package according to claim 1, characterized in that the material of the frame part (2) is recyclable paperboard or corrugated fiberboard.

9. The product package according to claim 1, characterized in that the product package (1) is a foodstuff package and the inner lining (6) is food-grade plastic.

10. The product package according to claim 1, characterized in that the frame part (2) comprises more than one support part (2*f*) to keep the nested product packages (1) at a distance from each other.

11. The product package according to claim 10, characterized in that the frame part (2) suitably comprises at least three support parts (2*f*), most preferably four or eight support parts (2*f*).

12. The product package according to claim 10, characterized in that on the side edges of each dividing wall (2*c*) of the frame part (2), and near the folding line (2*e*), are support parts (2*f*), or in that on the side edges of each side wall (2*a*) and of each end wall (2*b*) of the frame part (2), near the folding lines (4*e*) are support parts (2*f*), or in that on the side edges of each side wall (2*a*) of the frame part (2), near the folding line (4*e*), are support parts (2*f*), or in that on the side edges of each end wall (2*b*) of the frame part (2), near the folding line (4*e*), are support parts (2*f*), or in that the frame part (2) comprises a support part (2*f*) cut from each side wall (2*a*) and end wall (2*b*) of the frame part (2) and folded out from the wall (2*a*, 2*b*).

13. The product package according to claim 10, characterized in that in stacked product packages that are nested the support surface of the support part (2*f*) of the upper product package (1) rests on the top surface of the edge part (4*a*) of the lower product package (1), and in that the distance (E) of the support surface of the support part (2*f*) to the bottom surface of the edge part (4*a*) of the same product package (1) is suitably equal to or greater than one millimeter.

14. A product package blank that comprises a sheet-like structure manufactured from recyclable fiber material, the structure comprising a base sector, wall sectors and edge parts (4*a*) separated with folding lines (3*e*, 4*e*) and cuttings, for the base (3), walls (2*a*, 2*b*) and even, one-piece and essentially unbroken edge section (4) of a product package (1) to be manufactured by folding from the product package blank, characterized in that on the product package blank between the wall sectors are dividing wall sectors, separated from the base sector with folding lines (3*e*), for the dividing walls (2*c*), on the free end of which dividing wall sections is a reinforcement piece (2*d*) separated by means of a folding line (2*e*) and wherein each edge part (4*a*) has an end portion that extends from a side edge of the side wall (2*a*, 2*b*) and is acutely angled with respect to the side edge of the side wall (2*a*, 2*b*) such that ends of adjacent end portions form a corner seam (5) when the product package blank is folded into the product package, the reinforcement piece (2*d*) disposed under the corner seam and adjacent end portions when the product package blank is folded.

15. The product package blank according to claim 14, characterized in that the distance of the folding line (2*e*) of the reinforcement piece (2*d*) from the folding line (3*e*) surrounding the base sector is smaller by the extent of the material thickness of the product package blank than the distance of the folding line (4*e*) of the edge sectors from the folding line (3*e*) surrounding the base sector.

16. The product package blank according to claim 14, characterized in that in the product package blank (9) are support parts (2*f*) formed from wall sectors (2*a*, 2*b*, 2*c*).

* * * * *